US006722763B1

(12) United States Patent
Hsu et al.

(10) Patent No.: US 6,722,763 B1
(45) Date of Patent: Apr. 20, 2004

(54) INKJET PEN AND PRESSURE CONTROL DEVICE THEREOF

(75) Inventors: Cheng-Wei Hsu, Tainan Hsien (TW); Bo-Hsiang Wang, Taiping (TW); I-Chung Hou, Hsinchu (TW)

(73) Assignee: International United Technology, Hsin-Chu (TW)

( * ) Notice: Subject to any disclaimer, the term of this patent is extended or adjusted under 35 U.S.C. 154(b) by 0 days.

(21) Appl. No.: 10/337,749

(22) Filed: Jan. 7, 2003

(30) Foreign Application Priority Data

Oct. 18, 2002 (TW) ..... 91124093 A

(51) Int. Cl.[7] ..... B41J 2/175
(52) U.S. Cl. ..... 347/86; 347/87
(58) Field of Search ..... 347/84, 85, 86, 347/87

(56) References Cited

U.S. PATENT DOCUMENTS 5,537,134 A * 7/1996 Baldwin et al. ..... 347/85
6,151,052 A * 11/2000 Yang et al. ..... 347/87
6,186,620 B1 * 2/2001 Hsieh et al. ..... 347/84
6,213,598 B1 * 4/2001 Hou et al. ..... 347/86
6,367,666 B1 * 4/2002 Hou et al. ..... 222/386.5

* cited by examiner

*Primary Examiner*—Anh T. N. Vo
(74) *Attorney, Agent, or Firm*—Thomas, Kayden, Horstemeyer & Risley

(57) ABSTRACT

An inkjet pen and a pressure control device thereof. The inkjet pen comprises a body, a bag, a pressure plate, an abutting member, and a rib. The body includes a bubble generator. The bag is disposed inside the body, and communicates with the external environment so as to expand inside the body. The pressure plate, disposed inside the body and located adjacent to the bag so as to move inside the body, includes a first portion and a second portion. The first portion is located near the bubble generator. The abutting member is disposed in the body, and seals the bubble generator. The rib is disposed in the body and located near the second portion of the pressure plate. The second portion of the pressure plate is maintained at a predetermined position by the rib when the pressure plate is moved by the bag. Thus, the abutting member is properly moved by the first portion of the pressure plate when the pressure plate is moved by the bag.

19 Claims, 6 Drawing Sheets

230a

INKJET PEN AND PRESSURE CONTROL DEVICE THEREOF

BACKGROUND OF THE INVENTION

1. Field of the Invention

The invention relates to an inkjet pen and a pressure control device thereof; in particular, to an inkjet pen with a pressure control device that can properly actuate its bubble generator.

2. Description of the Related Art

Conventional ink-jet printing generally relies on the controlled delivery of ink droplets,from a reservoir of an inkjet pen to a print medium. Among the printing methods for delivering ink drops from the reservoir to the print head, drop-on-demand printing is known as a commonly used method. Drop-on-demand typically uses thermal bubble or piezoelectric pressure wave mechanisms. A thermal bubble type print head includes a thin film resistor heated to cause sudden vaporization of a small portion of ink. The rapid expansion of the ink vapor forces a small drop of ink through a print head nozzle. Although drop-on-demand printing is ideal for sending ink drops from a reservoir to the print head, some mechanism must be included to prevent ink leaking out from the print head when the print head is inactive. Such a mechanism usually builds a slight backpressure at the print head to prevent ink leakage from the pen when the print head is inactive. Herein, the term "backpressure" represents the partial vacuum within the reservoir. Backpressure is defined in the positive sense so that an increase in backpressure means the degree of partial vacuum has increased.

When the backpressure is established at all times inside the reservoir, ink is prevented from permeating through the print head. However, the backpressure cannot be so high that the print head is unable to overcome the backpressure to eject ink drops. Furthermore, as ambient air pressure decreases, a correspondingly greater amount of backpressure is needed to keep ink from leaking. Accordingly, the backpressure within the inkjet pen has to be regulated whenever ambient pressure drops. Also the pressure within the pen is subjected to what may be termed "operational effects", as the depletion of ink from the reservoir increasing the backpressure of the reservoir. Without regulation of this backpressure increase, the inkjet pen will fail quickly because the backpressure is too high for the print head to overcome and eject ink drops.

Conventionally, the backpressure within the reservoir is controlled by mechanism referred to as accumulators. In general, an accumulator includes an elastomeric bag capable of moving between a minimum volume position and a maximum volume position in response to changes in the backpressure within the reservoir. For example, as ambient pressure drops so that backpressure within the reservoir decreases simultaneously, the accumulator will move to increase the volume of the reservoir to thereby increase the backpressure to a level sufficient to prevent ink leakage. Another example is depletion occurring during operation of the pen. In such a case, accumulators will move to decrease the volume of the reservoir to reduce the backpressure to a level within operating range, thereby permitting the print head to continue ejecting ink.

However, although accumulators such as elastomeric bags can automatically adjust the volume of the reservoir to keep the backpressure within the operating range, the extent to which elastomeric bags are capable of expanding is quite limited. Consequently, when ink level gradually drops from the print head, the bag may reach its maximum extent and therefore become incapable of any further adjustment of the volume of the reservoir. Hence, the backpressure within the reservoir may increase such that ink droplets are prevented from leaving the print head.

To resolve the aforementioned problems, some inkjet pens employ a device called a "bubble generator". The bubble generator has an orifice through which ambient air can enter the reservoir. The dimension of the orifice is such that ink is trapped within the orifice to seal off the reservoir by capillary effect. When ambient air pressure is high enough to overcome the liquid seal, air can bubble into the reservoir. Therefore, the backpressure within the reservoir can decrease and capillary effect will take over and re-establish the liquid seal again to prevent entrance of more air bubbles.

In general, bubble generators of inkjet pens must satisfy a few conditions. Firstly, the bubble generator must be able to precisely control backpressure. Secondly, the range of fluctuation of the backpressure within the reservoir must be as small as possible. In other words, as air bubbles enter the reservoir leading to a drop in backpressure, the bubble generator must be able to stop the entrance of bubbles soon enough that sufficient backpressure remains inside. Thirdly, the bubble generator must have self-wetting capability. The liquid seal must be able to prevent the entrance of bubbles even when most of the ink within the reservoir is used up, or alternately when the inkjet pen is tilted such that the bubble generator is no longer immersed in the ink.

FIG. 1 shows a conventional inkjet pen 100 according to U.S. Pat. No. 6,213,598. The inkjet pen 100 comprises a flat spring 21 welded to the bottom of an inkjet pen 100. The flat spring 21 presses a sphere 22 of a bubble generator 30. An expandable bag 23 is in contact with a pressure plate 25, and the pressure plate 25 is supported by a spring 24. The flat spring 21, the sphere 22, the expandable bag 23, the spring 24, and the pressure plate 25 constitute a pressure control device 20 of the inkjet pen 100.

As stated above, in the conventional inkjet pen 100, the bubble generator 30 is actuated by the pressure plate 25. The pressure plate 25 is moved by the expandable bag 23. However, the motion of the pressure plate 25 by the expandable bag 23 is difficult to control.

Specifically, the pressure plate 25 is provided with a certain area; however, the contact area between the pressure plate 25 and the expandable bag 23 is very limited. Thus, when the pressure plate 25 is moved by the expandable bag 23, the bubble generator 30 cannot be properly actuated by the lower portion of the pressure plate 25. That is, when the pressure plate 25 is moved by the expandable bag 23, the upper portion of the pressure may be moved first. As a result, the lower portion of the pressure plate 25 may not be moved, thereby failing to properly actuate the bubble generator 30.

SUMMARY OF THE INVENTION

In view of this, the invention provides an inkjet pen with a pressure control device that can properly actuate its bubble generator.

Accordingly, the invention provides an inkjet pen. The inkjet pen comprises a body, a bag, a pressure plate, an abutting member, and a rib. The body includes a bubble generator. The bag is disposed inside the body, and communicates with the external environment so as to expand inside the body. The pressure plate, disposed inside the body and located adjacent to the bag so as to move inside the body, includes a first portion arid a second portion. The first portion is located near the bubble generator. The abutting member is disposed in the body, and seals the bubble generator. The rib is disposed in the body and located near the second portion of the pressure plate. The second portion of the pressure plate is maintained at a predetermined position by the rib when the pressure plate is moved by the bag. Thus, the abutting member is properly moved by the first portion of the pressure plate when the pressure plate is moved by the bag.

In a preferred embodiment, the rib is disposed on the pressure plate.

It is understood that the rib may be integrally formed on the pressure plate.

In another preferred embodiment, the rib is integrally formed on the body.

In another preferred embodiment, the abutting member is a spring leaf.

In another preferred embodiment, the abutting member is disposed on the first portion of the pressure plate.

In another preferred embodiment, the inkjet pen further comprises an elastic member disposed in the body, adjacent to the pressure plate.

It is understood that the elastic member may be a spring.

In another preferred embodiment, the bubble generator comprises a sealing member disposed in the body in a moveable manner so as to seal the bubble generator.

It is understood that the sealing member may be a sphere.

BRIEF DESCRIPTION OF THE DRAWINGS

The invention is hereinafter described in detail with reference to the accompanying drawings in which.

DETAILED DESCRIPTION OF THE INVENTION

Figure 1:
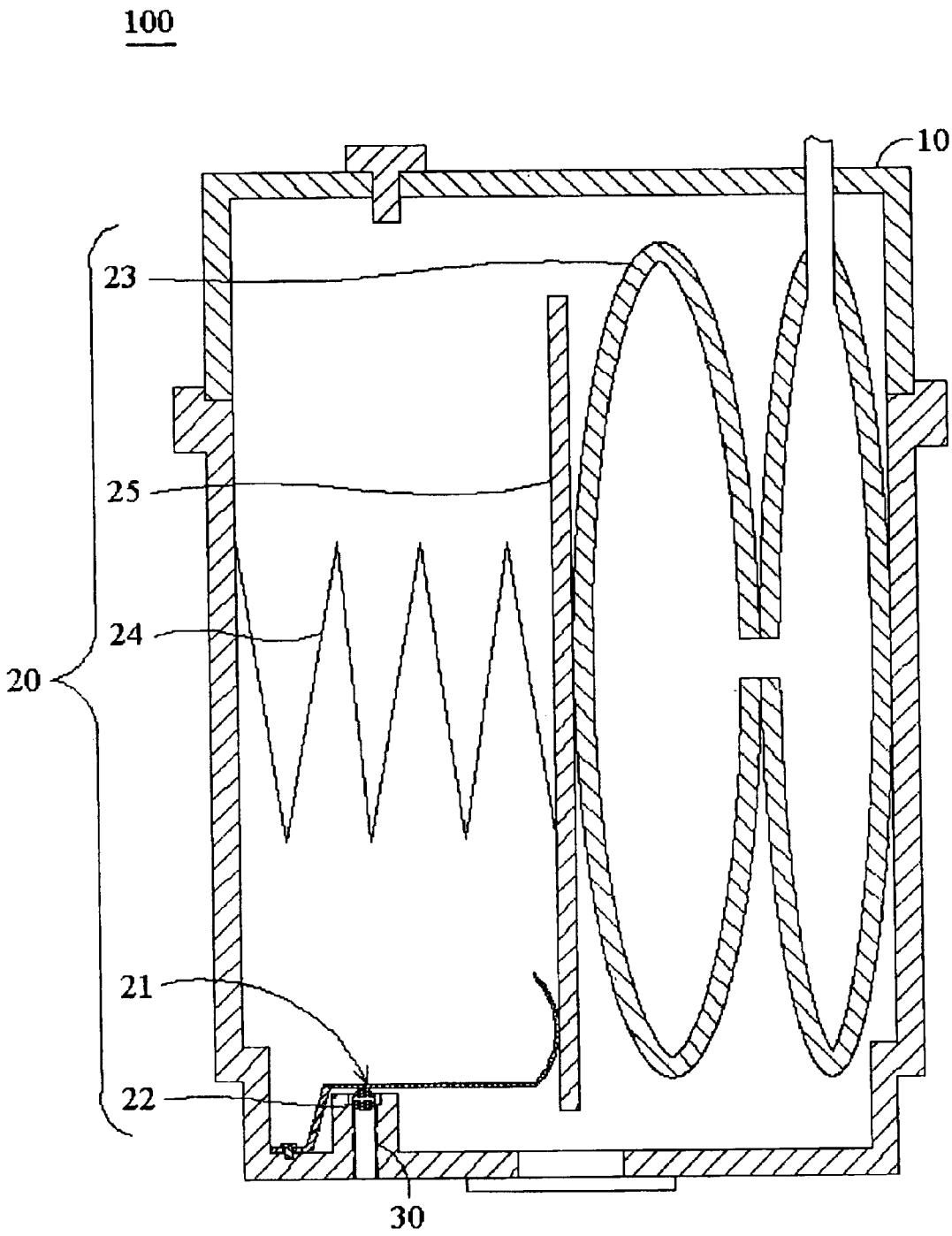
FIG. 1 ( PRIOR ART )
FIG. 1 is a cross section of a conventional inkjet pen.
Figure 2A:
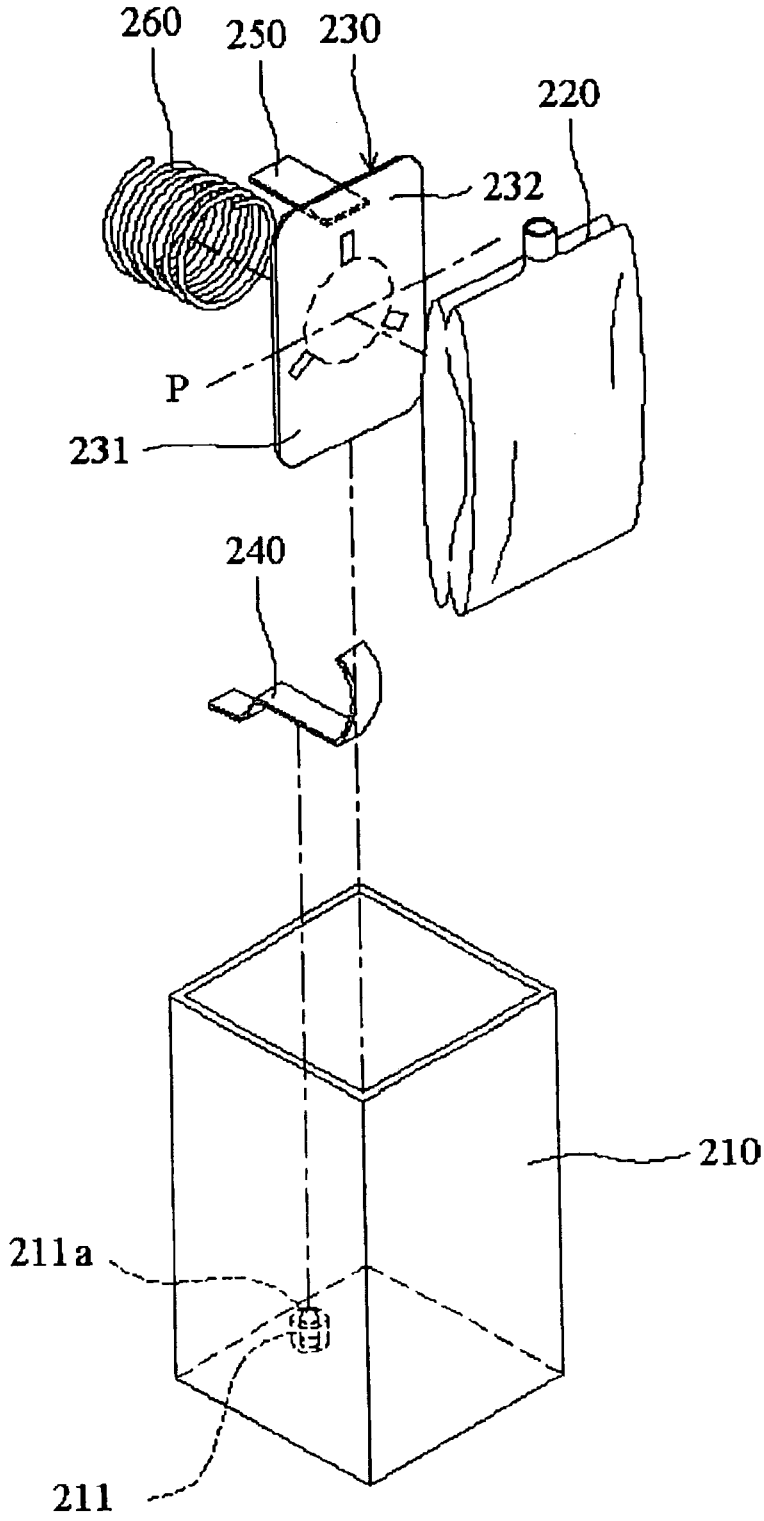
FIG. 2*a* is an exploded schematic view of an inkjet pen as disclosed in this invention.
Figure 2B:
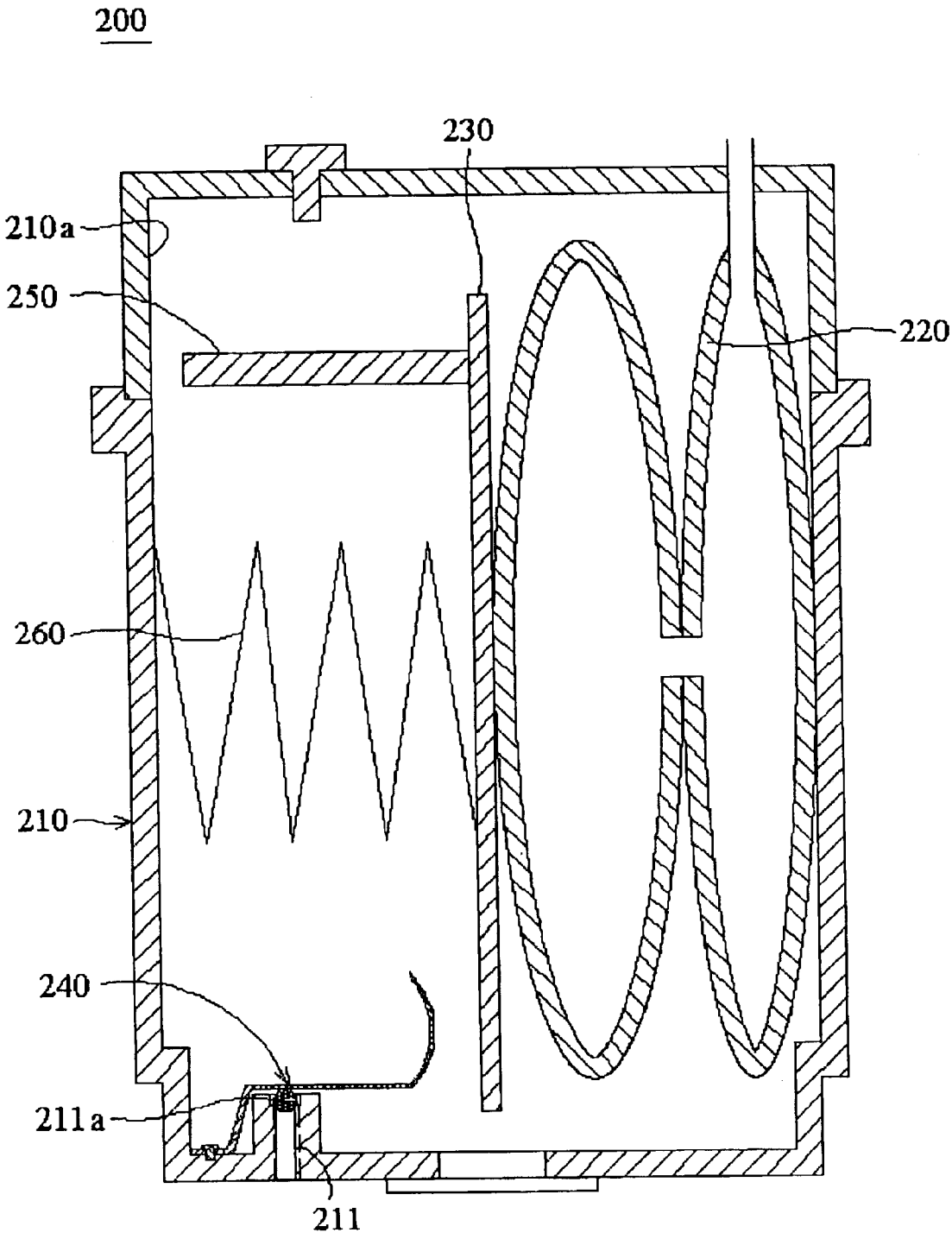
FIG. 2*b* is a cross section of the assembled inkjet pen in FIG. 2*a;*
Figure 2C:
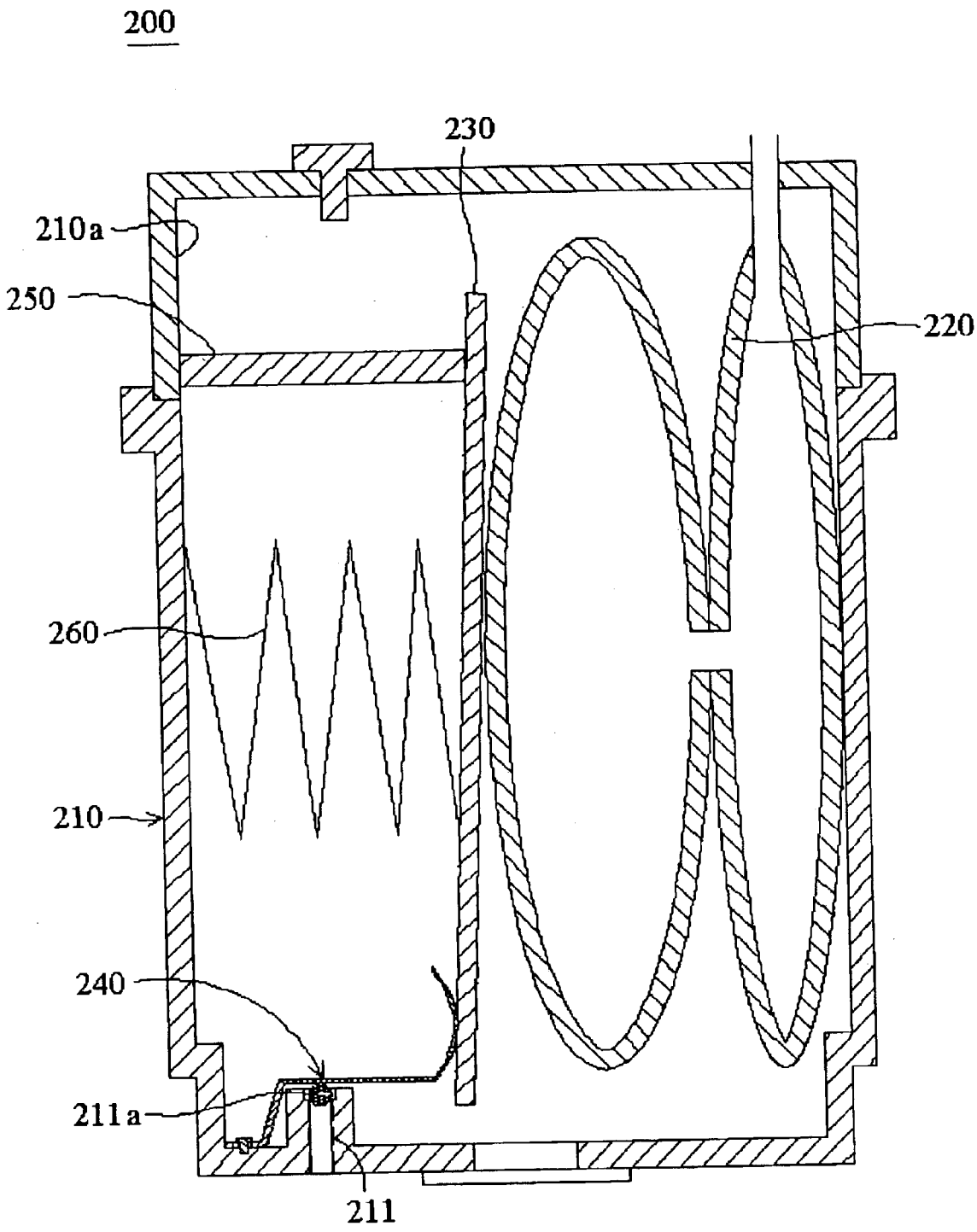
FIG. 2*c* is a cross section of the assembled inkjet pen in FIG. 2*a*, wherein a bag is expanded.

Referring to FIG. 2*a*, FIG. 2*b* and FIG. 2*c*, an inkjet pen 200 as disclosed in this invention is shown. The inkjet pen 200 comprises a body 210, a bag 220, a pressure plate 230, an abutting member 240, a rib 250, and an elastic member 260.

The body 210 is a basic component of the inkjet pen 200, and includes a bubble generator 211 at its bottom. The bubble generator 211 comprises a sealing member 211*a*. The sealing member 211*a* is disposed in a passage of the bubble generator 211 in a moveable manner, and seals the passage of the bubble generator 211. It is understood that the sealing member 211*a* may be a sphere as shown in FIG. 2*a*.

The bag 220 is disposed inside the body 210, and communicates with the external environment so as to expand inside the body 210. The pressure plate 230 is disposed inside the body 210, and is located adjacent to the bag 220 so as to move inside the body 210. The pressure plate 230 is divided into two portions by a central line p to include a lower portion (hereinafter referred to as a first portion) 231 and an upper portion (hereinafter referred to as a second portion) 232. The first portion 231 is located near the bubble generator 211.

The abutting member 240 is disposed in the body 210, and seals the bubble generator 211. It is understood that the abutting member 240 may be a spring leaf. It is preferred that the abutting member 240 is not abutted by the first portion 231 of the pressure plate 230 when the bag 220 is not expanded as shown in FIG. 2*b*.

The rib 250 is disposed in the body 210, and located near the second portion 232 of the pressure plate 230. In FIG. 2*a*, FIG. 2*b* and FIG. 2*c*, the rib 250 is disposed on the pressure plate 230, but is not limited thereto. It is preferred that'the rib 250 is not abutted by an inner wall 210*a* of the body 210 when the bag 220 is not expanded as shown in FIG. 2*b*.

The elastic member 260 is disposed in the body 210 in a manner such that it is adjacent to the pressure plate 230. It is understood that the elastic member 260 may be a spring.

In a preferred embodiment, when the pressure plate 230 is moved due to the expansion of the bag 220, the rib 250 is abutted by the inner wall 210*a* of the body 210 so that the second portion 232 of the pressure plate 230 can be maintained at a predetermined position by the rib 250. Thus, the first portion 231 of the pressure plate 230 can be properly pressed by the bag 230 so that the abutting member 240 can be actually moved by the first portion 231 of the pressure plate 230 so as to actuate the bubble generator 211. In another embodiment, if the rib 250 is abutted by the inner wall 210*a* of the body 210 before the bag 220 is expanded, the second portion 232 of the pressure plate 230 can be maintained at its original position after the bag 220 is expanded. Then, the abutting member 240 is moved by the first portion 231 of the pressure plate 230 so as to actuate the bubble generator 211.

Figure 3:
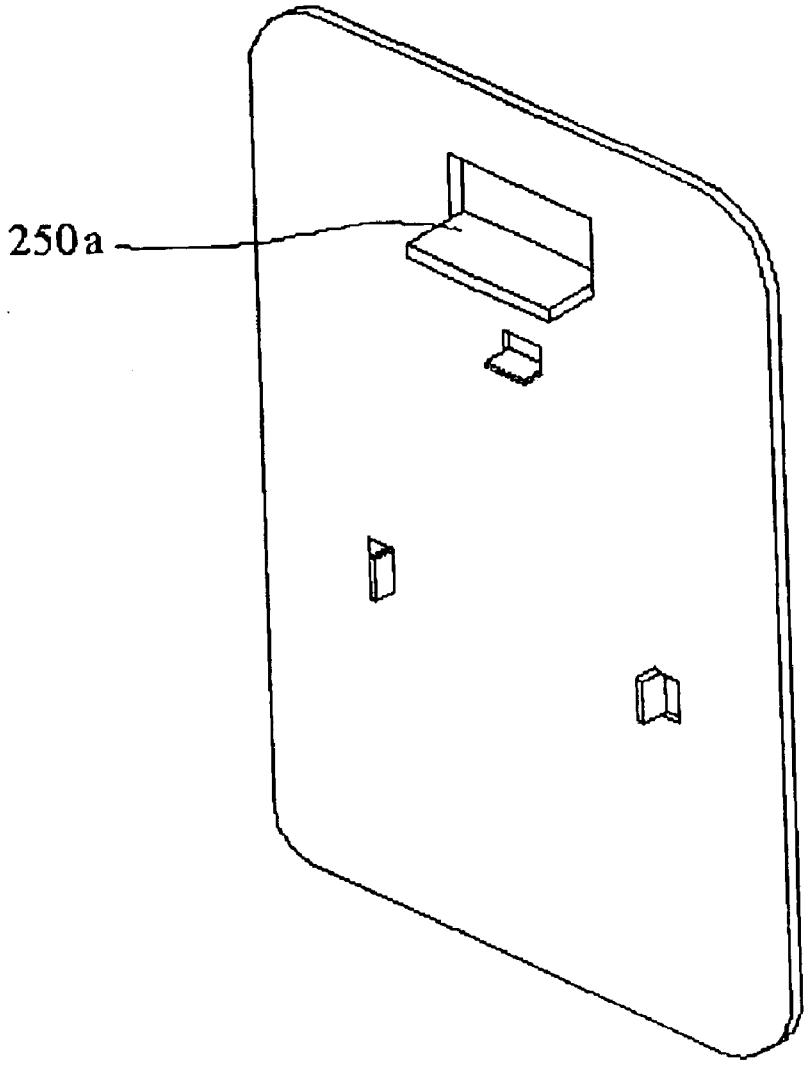
FIG. 3 is a schematic view of a variant embodiment of a pressure plate in FIG. 2*a*.

As shown in FIG. 3, the rib 250 can be integrally formed on the pressure plate 230*a* by press to reduce the number of the parts of the inkjet pen.

Figure 4:
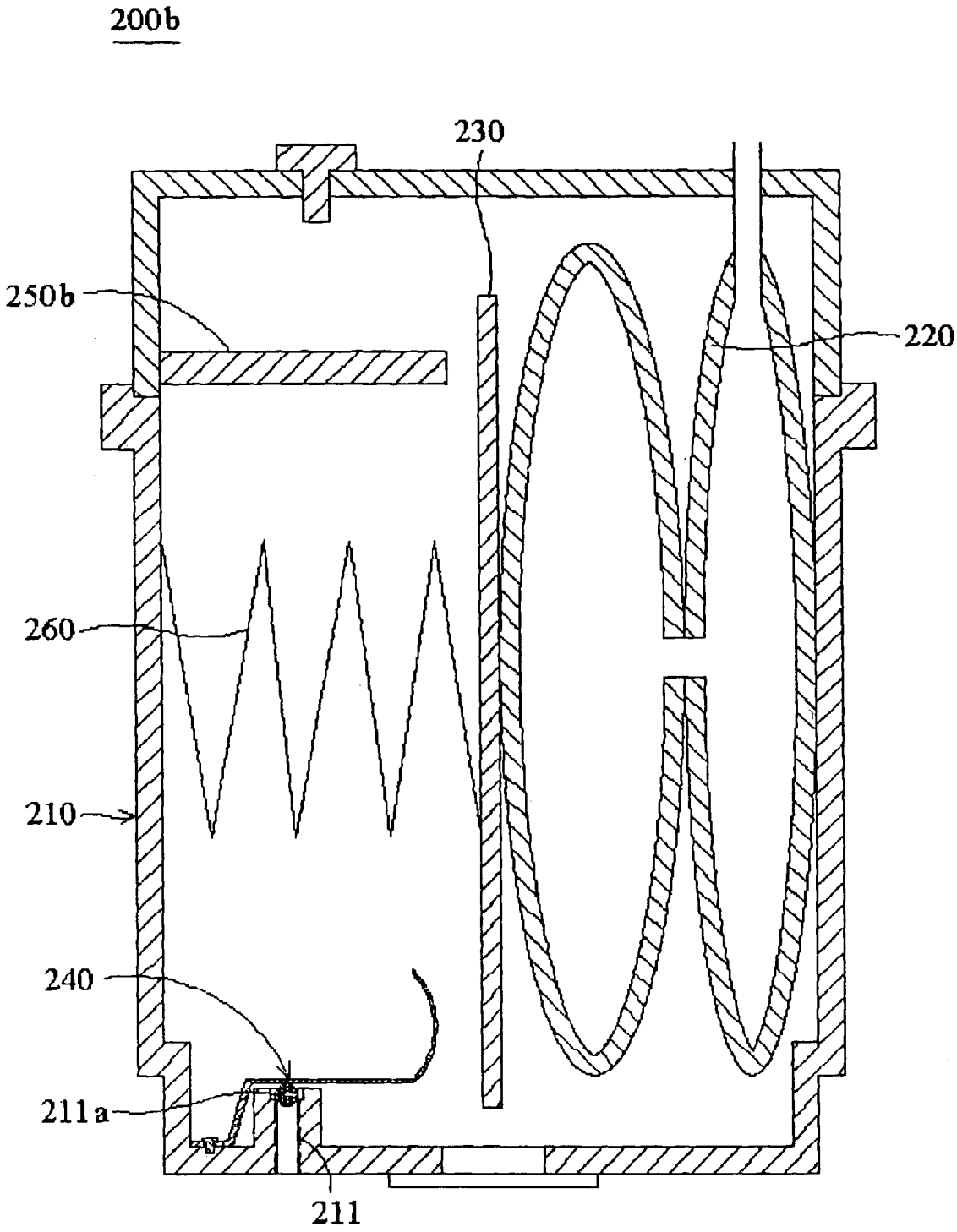
FIG. 4 is a schematic view of a variant embodiment of an inkjet pen as disclosed in this invention.

In addition, the rib is not restrained to disposition on the pressure plate. For example, as shown in FIG. 4, the rib 250*b* may be integrally formed on the body 210. Thus, the position of the rib is not restrained the abovementioned description as long as the upper portion of the pressure can be maintained at the specified position due to the rib or the like, and let the lower portion of the pressure plate be moved and in turn moves the abutting member 240 so as to actuate the bubble generator 211.

By the structure of the inkjet pen of this invention, the bubble generator can be properly actuated While the invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiments, those alternatives which have been discussed above, and all equivalents thereto.

What is claimed is:

1. An inkjet pen comprising:

a body including a bubble generator;

a bag, disposed inside the body, communicating with the external environment so as to expand inside the body;

a pressure plate, disposed inside the body and located adjacent to the bag so as to move inside the body, including a first portion and a second portion, wherein the first portion is located near the bubble generator;

an abutting member, disposed in the body, for sealing the bubble generator; and a rib disposed in the body and located near the second portion of the pressure plate, wherein the second portion of the pressure plate is maintained at a predetermined position by the rib when the pressure plate is moved by the bag, whereby the abutting member is properly moved by the first portion of the pressure plate when the pressure plate is moved by the bag.

2. The inkjet pen as claimed in claim 1, wherein the rib is disposed on the pressure plate.

3. The inkjet pen as claimed in claim 2, wherein the rib is integrally formed on the pressure plate.

4. The inkjet pen as claimed in claim 1, wherein the rib is integrally formed on the body.

5. The inkjet pen as claimed in claim 1, wherein the abutting member is a spring leaf.

6. The inkjet pen as claimed in claim 1, wherein the abutting member is disposed on the first portion of the pressure plate.

7. The inkjet pen as claimed in claim 1, further comprising an elastic member disposed in the body, adjacent to the pressure plate.

8. The inkjet pen as claimed in claim 7, wherein the elastic member is a spring.

9. The inkjet pen as claimed in claim 1, wherein the bubble generator comprises a sealing member, disposed in the body in a moveable manner, for sealing the bubble generator.

10. The inkjet pen as claimed in claim 9, wherein the sealing member is a sphere.

11. A pressure control device for an inkjet pen, having a bubble generator and maintaining backpressure generated therein, comprising a bag, disposed inside the inkjet pen, communicating with the external environment so as to expand inside the inkjet pen;

a pressure plate, disposed inside the inkjet pen and located adjacent to the bag so as to move inside the inkjet pen, including a first portion and a second portion, wherein the first portion is located near the bubble generator;

an abutting member, disposed in the inkjet pen, for sealing the bubble generator; and a rib disposed in the inkjet pen and located near the second portion of the pressure plate, wherein the second portion of the pressure plate is maintained at a predetermined position by the rib when the pressure plate is moved by the bag, whereby the abutting member is properly moved by the first portion of the pressure plate when the pressure plate is moved by the bag.

12. The pressure control device as claimed in claim 11, wherein the rib is disposed on the pressure plate.

13. The pressure control device as claimed in claim 12, wherein the rib is integrally formed on the pressure plate.

14. The pressure control device as claimed in claim 11, wherein the abutting member is a spring leaf.

15. The pressure control device as claimed in claim 11, wherein the abutting member is disposed on the first portion of the pressure plate.

16. The pressure control device as claimed in claim 11, further comprising an elastic member disposed in the body, adjacent to the pressure plate.

17. The pressure control device as claimed in claim 16, wherein the elastic member is a spring.

18. The pressure control device as claimed in claim 11, wherein the bubble generator comprises a sealing member, disposed in the body in a moveable manner, for sealing the bubble generator.

19. The pressure control device as claimed in claim 18, wherein the sealing member is a sphere.

* * * * *